United States Patent [19]

Lefor

[11] Patent Number: 4,621,846

[45] Date of Patent: Nov. 11, 1986

[54] LOCK FOR SLIDING DOORS

[76] Inventor: Don Lefor, 133 Lakeview Way, Oldsmar, Fla. 33557

[21] Appl. No.: 656,521

[22] Filed: Oct. 1, 1984

[51] Int. Cl.[4] ..... E05C 19/06

[52] U.S. Cl. ..... 292/152; 292/306; 292/288

[58] Field of Search ..... 292/150, 152, 178, 264, 292/306, 349, 341.17, 288

[56] References Cited

U.S. PATENT DOCUMENTS

| | | | |
|---|---|---|---|
| 373,986 | 11/1887 | Kelly | 292/206 X |
| 671,147 | 4/1901 | Robbins et al. | 292/306 |
| 860,816 | 7/1907 | Marcum | 292/306 |
| 886,853 | 5/1908 | Paulson | 292/152 |
| 1,236,618 | 8/1917 | Stagman | 292/152 X |
| 1,548,530 | 8/1925 | Knight | 292/152 |
| 1,575,429 | 3/1926 | Laurence | 292/264 |
| 1,580,611 | 4/1926 | Kirkpatrick | 70/90 |
| 2,415,398 | 2/1947 | Adam | 292/91 |

FOREIGN PATENT DOCUMENTS

| | | | |
|---|---|---|---|
| 536249 | 11/1930 | Fed. Rep. of Germany | 292/178 |
| 5611 | of 1904 | United Kingdom | 292/306 |

*Primary Examiner*—Richard E. Moore

*Attorney, Agent, or Firm*—Ronald E. Smith

[57] ABSTRACT

A device that prevents the unauthorized removal of a retainer pin that is slideably disposed within a bore which is collectively defined by a plurality of bores formed in the doors or windows to be locked, or frames therefor, when the same are fully closed. The device is a flat, elongate member having a transverse bend formed therein so that the device provides an inclined wall portion that projects at an angular relation to a base portion thereof. The inclined wall is apertured to receive the retainer pin and the edges of the aperture frictionally engage the pin so that it can not be removed from the bore within which it is disposed in the absence of a transient deformation of the inclined wall which decreases the angle between the inclined wall portion and the base portion of the device, thereby causing the edges of the aperture to release the pin.

2 Claims, 3 Drawing Figures

LOCK FOR SLIDING DOORS

BACKGROUND OF THE INVENTION

1. Field of the Invention

This invention relates to security devices in general, and relates more specifically to a device that retains a locking pin in a bore so that the pin can not be removed from the bore from outside the secured premises unless a portion of the device is temporarily displaced from its at rest position.

2. Description of the Prior Art

A search of U.S. patents that was conducted prior to the filing of this disclosure located the following patents in the field of this invention: Nos. 3,490,802; 4,190,272; 4,268,074; 4,293,154 and 4,400,027. None of these patents is pertinent to the invention as claimed herein. The most recent patent, No. 4,400,027, shows a device that requires the consumer to squeeze a key in order to remove a lock from a bore, but the device has no application in the environment of the present invention.

The environment of the present invention includes doors and windows that are lockable at least in part by a pin that is slideably disposed through bores specifically provided in the items to be locked and their associated frames or tracks. Sliding doors made of glass, commonly known as glass sliding doors or patio doors, are typically mounted on rollers in parallel tracks so that when the same are fully closed the right (metallic) frame of the left door and the left (metallic) frame of the right door enter into alignment with one another. Each frame has a bore formed therein so that a single bore extends through both frames when the same are aligned, and a pin extends through the bore to prevent opening of the doors in the absence of pin removal.

The doors may be secured in slightly different ways involving a pin. For example, opposing flanges on the track within which the doors "slide" may be cooperatively apertured to receive a pin which spans the track rearwardly of a door to thereby bar the rearward travel of the door. Moreover, such pins have utility in the context of certain styles of windows, and in such contexts the pins also extend through aligned bores to defeat unauthorized displacement of the closed windows.

Thus, the retainer pin employed in this invention and the environment within which the pin is used are well known. It is the means for retaining the pin within its bore that is the subject of this invention.

Burglars easily defeat the pins by simply shaking the sliding glass doors until the pin falls from its bore. In installations where the distal end of the pin is exposed to the outside, then the burglar need merely push the pin out of its bore to gain entry into the premises.

A pin retainer specifically adapted to prevent the unauthorized retraction of these well known pins does not appear in the art.

SUMMARY OF THE INVENTION

The longstanding but heretofore unfulfilled need for a pin retainer that defeats attempts to remove the pin from its bore is now fulfilled in the form of an elongate flat member having a transverse bend formed therein and an aperture formed in the portion thereof disposed in angular relation to the base portion thereof. The device is fixedly secured to a support surface and specifically positioned so that the aperture formed in the inclined portion thereof is in alignment with the bores formed in the items to be secured. In this manner, when the pin is positioned in the aperture formed in the inclined portion of the device and in the pre-existing bores, the angle at which such aperture is disposed causes the edges of the aperture to engage the pin so that the pin may not undergo distal to proximal displacement. The angled portion of the device must be displaced from its at rest position by an individual already inside the secured premises in order to allow the aperture to disengage the pin.

It is therefore seen that the primary object of this invention is to provide a security device that prevents the unauthorized opening of sliding doors and windows of the type secured at least in part by pins.

Another object is to provide such a device that is easily deactivated when an authorized person desires to remove the pin from its locking relationship with a door or window.

A more specific object is to provide a device that not only resists unauthorized removal of a pin from a bore, but which actually causes the amount of resistance presented by a pin to an intruder to increase proportionately to the amount of force exerted against the pin by such intruder.

The invention accordingly comprises the combination of elements, features of construction and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
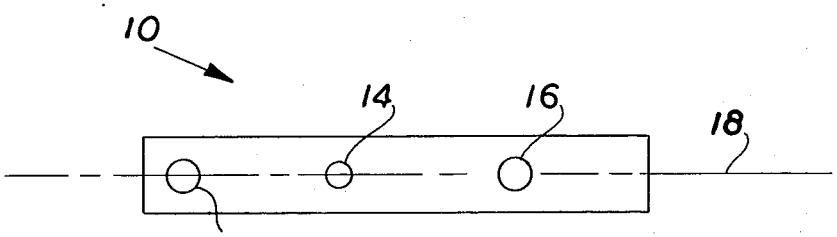
FIG. 1 is a top plan view of the strip of material from which the preferred embodiment of the invention is formed, as said strip appears prior to the formation of said strip into the device.

Refering now to FIG. 1, it will there be seen that the material from which the device which is the subject of this invention is formed is designated by the reference numeral 10 as a whole.

The item 10 is a rectangular in configuration, flat strip of metal, although it could be formed of a suitable plastic or other material which has the characteristics to be described herein. The strip 10 has formed therein a plurality of longitudinally spaced apertures, designated 12, 14 and 16, the respective centers of which are coincident with the longitudinal axis of symmetry 18 of strip 10.

Figure 2:
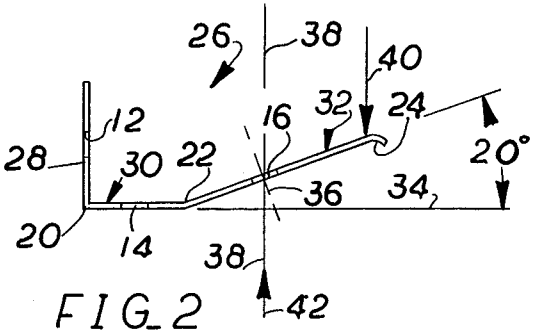
FIG. 2 is a side elevational view of the device after the strip of FIG. 1 has been worked into the shape shown.

In accordance with the teachings of this invention, a ninety (90) degree bend is formed in strip 10 as at 20 in FIG. 2. This transverse bend is formed intermediate apertures 12 and 14. A second bend is formed intermediate apertures 14 and 16, as indicated by the reference numeral 22 in FIG. 2, and a very minor curvature 24 is formed in the distal free end of the strip 10 to complete the transformation of the strip 10 into the device 26.

Device 26 is thus provided with three (3) distinct portions, each having a different function but all cooperating with one another to fulfill the objects of this invention. The first portion is designated as 28 and is the upstanding portion in FIG. 2. The medial portion will be hereinafter referred to as the base portion 30, and the distal portion will be referred to as inclined wall 32.

Figure 3:
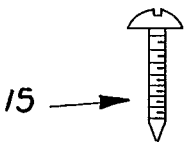
FIG. 3 is a side elevational view of a fastening means of the type having utility in securing the inventive device to a support surface.

When device 26 is operatively disposed in its intended environment, base portion 30 is fixedly secured to support surface, indicated as 34 in FIG. 2. Rotation of FIG. 2 in a counterclockwise direction by ninety (90) degrees results in a view that shows the device 26 in its operative disposition. A screw member or other suitable fastening device, shown in FIG. 3 and identified by the reference numeral 15'', is driven into support surface 34 through aperture 14 to thereby fixedly secure base portion 30 to such support surface. The surface 34 could be a frame of a door to be protected or an adjacent wall surface.

In the preferred embodiment of the invention, the angle of inclination of inclined wall portion 32 relative to support surface 34 is twenty (20) degrees. However, slight variations of this angle also produce an operable device. It should be observed that line 36 drawn through the center of aperture 16 forms a one hundred ten (110) degree angle relative to the plane of the base portion 30 or the plane of the support surface 34.

The characteristics of the material from which the device 26 is formed must include flexibility, resilience and semi-rigidity. It is believed that many metals and plastics can provide the needed flexibility, resilience and rigidity, although in a contemplated commercial embodiment of the invention the material to be employed is spring steel, gage 21 or 22. Spring steel of such gage is sufficiently flexible in that it can be bent from a strip 10 into the device 26, and is sufficiently rigid so that it holds its shape thereafter, and is sufficiently resilient so that when the twenty (20) degree angle of inclined wall portion 32 is altered in the manner hereinafter described, said portion 32 will return to its equilibrium position which position is depicted in FIG. 2.

The device 26 is used as follows. When base portion 30 is secured to the support surface 34 as mentioned above, care is taken to align aperture 16 in inclined wall portion 32 with the bores existing in the doors or windows to be locked. Thus, the pre-existing bores and the aperture 16 will enter into axial alignment with one another when the subject door or window is fully closed. The longitudinal axis of symmetry of the collective bores is indicated by the line 38 in FIG. 2. The retainer pin, not shown, is an elongate, cylindrical in configuration rod that extends through aperture 16 and the bores formed in the doors or windows and associated frames of such doors and windows. Thus, line 38 also represents the longitudinal axis of symmetry of the pin when it is operably installed.

It should be understood that the distal end of the retainer pin is inserted through aperture 16 and the bores, not shown, formed in the items to be secured. Thus, the proximal end of the pin is graspable by the user of the device 26 if the user is in the interior of the premises sought to be protected, and is not graspable by anyone outside the premises.

Likewise, the inclined wall portion is graspable by an individual inside the premises, but not by someone external thereto. Specifically, the angle of inclination of inclined wall portion 32 relative to support surface 34 may be decreased by a person interior of the premises by depressing wall portion 32 in the direction indicated by the directional arrow 40 in FIG. 2. Such a depression will result in a decrease of the one hundred ten (110) degree angle between line 36 and support surface 34, and the decrease of such angle attendant depression of portion 32 allows the user of the invention to insert or retract the pin into or from the bores and the aperture 16. In the absence of such depression, the twenty (20) degree angular orientation between the pin and the aperture 16 will prevent retraction of the pin. Specifically, if an axially directed force such as the distal to proximal force indicated by the directional arrow 42 in FIG. 2 is applied to the pin, in the absence of simultaneous depression of inclined wall portion 32, the edges of aperture 16 will bitingly or frictionally engage the cylindrical surface of the pin and prevent its distal to proximal displacement.

As the force represented by arrow 42 increases in magnitude, the locking force between the rod and aperture 16 will increase as the inclined wall portion 32 is driven in a distal to proximal direction, i.e., as inclined wall 32 rotates counterclockwise relative to bending line 22. Such movement of wall 32 increases the angle between line 36 and support surface 34 and thus causes the edges of aperture 16 to impinge with increased force upon the cylindrical surface of the pin.

The pin may be chained to the device 26 in a conventional manner and stored when not in use by insertion into the aperture 12 formed in the upstanding portion 28, which portion 28 is horizontally disposed when the device 26 is deployed in its environment as above described.

It will thus be seen that the objects set forth above, and those made apparent by the foregoing description, are efficiently attained, and since certain changes may be made in the above construction without departing from the scope of the invention, it is intended that all matters contained in the foregoing description, or shown in the accompanying drawings, shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, that which is claimed is:

1. A device that prevents distal to proximal travel of a pin in a bore responsive to distal to proximal forces acting against the distal end of said pin, said device having utility in the environment of sliding doors and frames therefor provided with independent bores that align axially when the doors are fully closed to collectively define a bore within which the pin is slideably mounted, wherein the improvement comprises:

a flat base member, an aperture formed in said base member, a fastening means such as a screw or a nail adapted to extend through said aperture, a support surface to which said base member is mounted by said fastening means, said support surface defining a frame of a door to be locked by said device, a flat, elongate inclined wall member integrally formed with said base member and projecting therefrom in a plane angularly disposed relative to a plane of said base member, an aperture formed in said inclined wall member near the distal free end thereof, a pin extending through the aperture formed in said wall member and through a bore collectively defined by a first bore formed in a first sliding door and a second bore formed in a second sliding door when said doors are fully closed, said pin being disposed normal to a plane of said support surface when said pin is positioned in said aperture, said wall member inclined by an angular amount sufficient to cause the circumferential edges of said aperture formed therein to frictionally engage said pin when said wall member is in its equilibrium disposition, said frictional engagement of said pin and said aperture formed in said inclined wall member being maintained when said pin is displaced in a distal to proximal direction, which displacement accordingly imparts distal to proximal displacement to said wall member, which latter displacement serves to increase the angular orientation of said aperture formed in said wall member relative to said pin and to thereby increase the amount of friction appearing between said aperture and said pin, said wall member and said base member formed of a semi-rigid, flexible and resilient material so that the angular disposition of the wall member relative to the base member is maintained in the absence of external forces acting against said wall member and so that the angular disposition is changed responsive to the application of external forces to said wall member, said aperture formed in said wall member releasing its frictional engagement with said pin when said wall member is displaced by external forces in a proximal to distal direction, which displacement reduces the amount of angular displacement of said aperture relative to said pin so that said pin can be removed from said aperture and said bore, the angular disposition between the inclined wall member and the base member being approximately twenty degrees, and said device further including an apertured member that is bent ninety degrees relative to the base member.

2. The device of claim 1, wherein such device is formed of spring steel.

* * * * *